United States Patent [19]

Ackermann

[11] Patent Number: 4,791,875

[45] Date of Patent: Dec. 20, 1988

[54] NEEDLE GUARD FOR SEWING MACHINE

[75] Inventor: Manfred Ackermann, Elmhurst, Ill.

[73] Assignee: Union Special Corporation, Chicago, Ill.

[21] Appl. No.: 76,517

[22] Filed: Jul. 22, 1987

[51] Int. Cl.[4] ..... D05B 55/06

[52] U.S. Cl. ..... 112/227

[58] Field of Search ..... 112/165, 197, 199, 227

[56] References Cited

U.S. PATENT DOCUMENTS 2,857,868 10/1958 Baum ..... 112/227

4,428,314 1/1984 Renaud ..... 112/227

4,438,717 3/1984 Minella et al. ..... 112/227

4,522,135 6/1985 Ketterer ..... 112/199

*Primary Examiner*—Wm. Carter Reynolds

*Attorney, Agent, or Firm*—Powell L. Sprunger

[57] ABSTRACT

A needle guard for sewing machines having a reciprocating needle, a looper, and a guard member portioned adjacent a lower end of the needle during reciprocation thereof. The guard member has a plurality of faces projecting a different distance towards the needle, and the guard has a device for selectively positioning one of the faces towards the needle.

10 Claims, 2 Drawing Sheets

NEEDLE GUARD FOR SEWING MACHINE

BACKGROUND OF THE INVENTION

The present invention relates to needle guards for a sewing machine.

Sewing machines having a looper and a reciprocating needle are well known. In such machines, the needle is placed in a lower position to pick up the thread by the looper during sewing. However, during sewing of certain fabrics, such as seams, the needle may be deflected, and it is desireable to maintain the proper position of the needle relative to the looper to properly pick up the thread. It is also desirable to accomplish this procedure for needles of differing sizes. Sewing machines having needle guiding devices are disclosed in U.S. Pat. Nos. 934,954, 1,157,892, and 4,606,288, incorporated herein by reference.

SUMMARY OF THE INVENTION

A principal feature of the present invention is the provision of an improved needle guard for sewing machines.

The needle guard of the present invention comprises, a reciprocating needle, a looper, and a guard member positioned adjacent a lower end of the needle during reciprocation thereof.

A feature of the present invention is that the guard member has a plurality of faces projecting a different distance towards the needle.

Another feature of the invention is the provision of means for selectively positioning one of the faces toward the needle.

Thus, a feature of the present invention is that in event of deflection of the needle, the guard member causes correct positioning of the needle relative to the looper in order to properly pick up the thread.

Still another feature of the invention is that the guard member may be selectively positioned relative to the needle utilizing different faces for different sizes of the needles.

Further features will become more fully apparent in the following description of the embodiments of this invention and from the appended claims.

DESCRIPTION OF THE PREFERRED EMBODIMENTS

Figure 1:
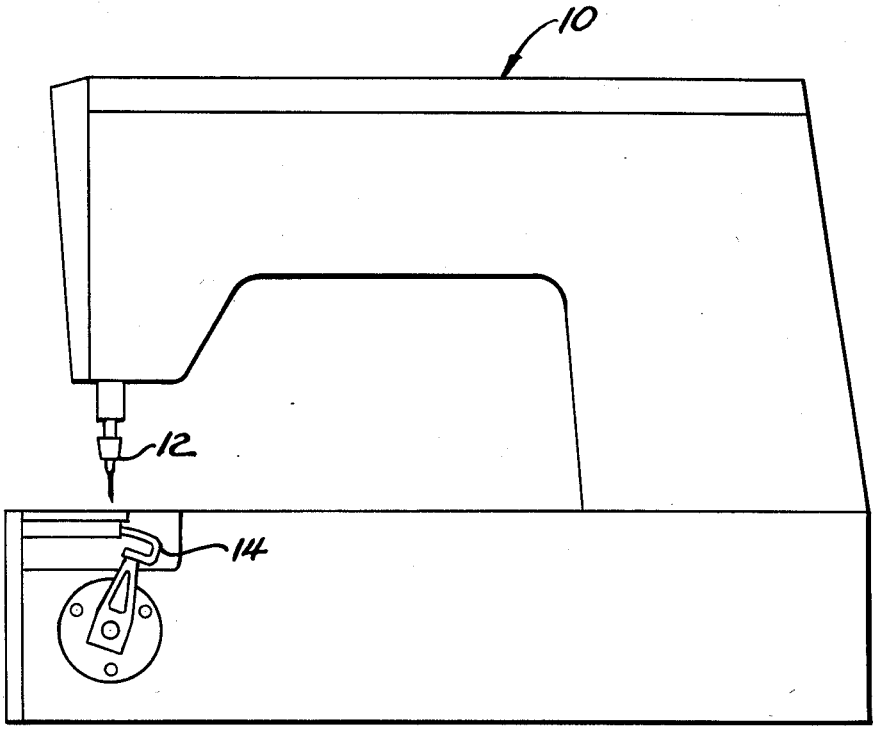
FIG. 1 is an elevational view of a sewing machine which has a needle guard according to the present invention.
Figure 2:
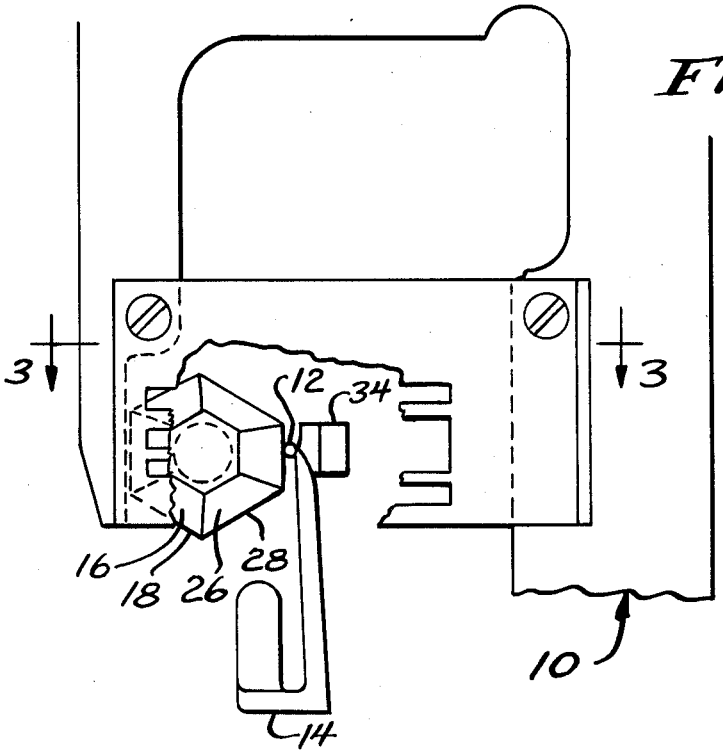
FIG. 2 is a fragmentary plan view of a portion of the machine of FIG. 1 illustrating the guard member of the present invention.

Referring now to FIGS. 1–5, there is shown a sewing machine generally designated 10 having a reciprocating needle 12, a looper 14, and a needle guard 16 according to the present invention. The needle guard 16 may be utilized in a Federal Stitch Type 401 as part of a Federal Stitch Type 516 of the sewing machine 10.

Figure 4:
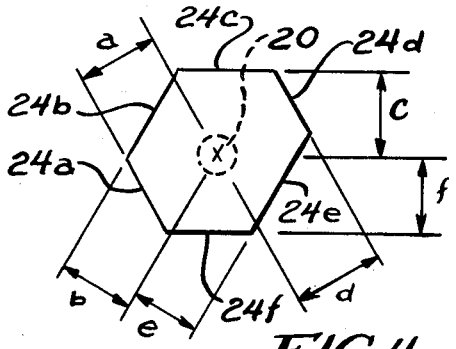
FIG. 4 is a plan view of a needle guard according to on embodiment of the present invention.
Figure 5:
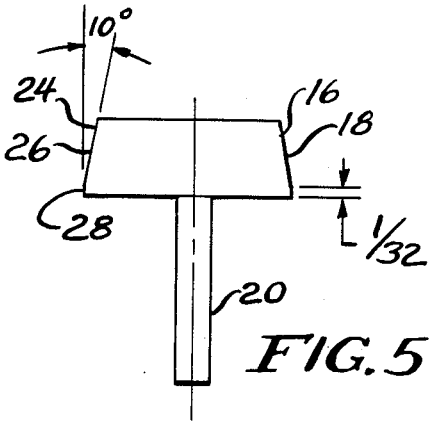
FIG. 5 is an elevational view of the needle guard of FIG. 4.

The needle guard 16 has a guard member 18 positioned adjacent a lower end of the needle 12 during its reciprocation by the sewing machine 10. The guard member 18 has a central lower shaft 20 extending from the guard member 18 and being rotatably received in an opening 22 of the sewing machine 10. The guard member 18 has a plurality of faces **24*a*, 24*b*, 24*c*, 24*d*, and, 24*f* projecting a different distance from a center of the shaft 20 towards a lower end of the needle during reciprocation thereof. In the embodiment of FIGS. 1–5, the guard member 18 is illustrated as having six faces which are selectively positioned towards the needle 12. With reference to FIG. 4, the face 24*a* may project a distance of approximately 0.132 inches from the center of the shaft 20, the face 24 may project a distance of approximately 0.137 inches from the center of the shaft 20, the face 24*c* may project a distance of approximately 0.142 inches from the center of the shaft 20, the face 24*d* may project a distance of approximately 0.147 inches from the center of the shaft 20, the face 24*e* may project a distance of approximately 0.122 inches from the center of the shaft 20, and the face 24*f* may project a distance of approximately 0.137 inches from the center of the shaft 20. With reference to FIG. 5, the guard member 18 may have an upper tapered or beveled portion 26 being slanted approximately 10 degrees from the vertical, and a lower verticle base portion 28** which may have a thickness of approximately 1/32 inches.

Figure 3:
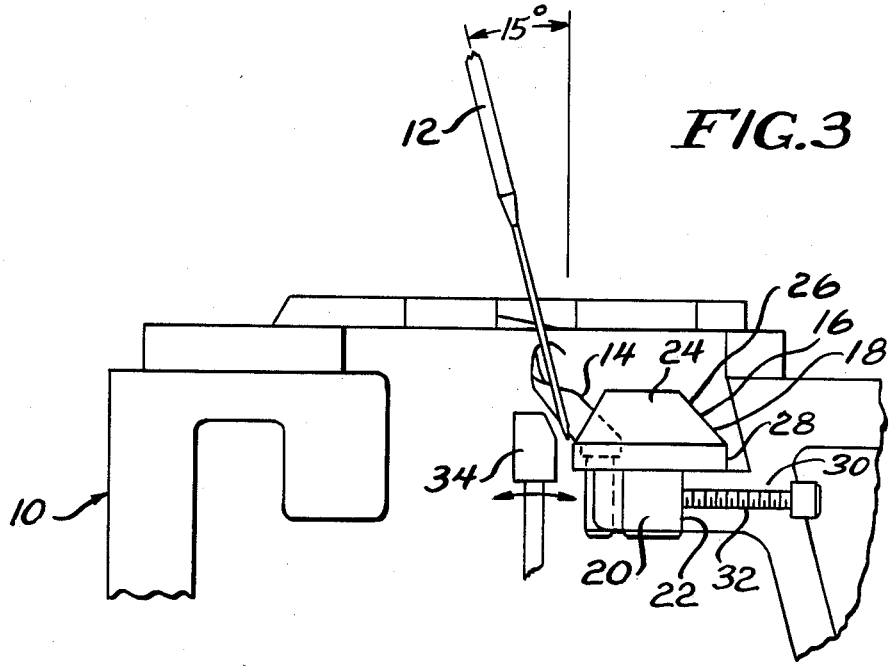
FIG. 3 is a fragmentary sectional view taken substantially as indicated along the line 3–3 of FIG. 2.

With references to FIG. 3, the sewing machine 10 has a threaded screw 30 received in a threaded bore 32 of the sewing machine, such that the screw 30 may selectively bear upon the shaft 20 of the needle guard 16. In the particular embodiment shown, the needle 12 may be slanted approximately 15 degrees from the vertical direction. As shown, the sewing machine 10 may have a rear needle guard 34 which may be selectively pivoted and secured during sewing, as indicated by the direction of the arrows in FIG. 3.

In use, the needle guard 16 may be utilized for needles 12 of different size diameters. Intially, the screw 30 is loosened in the sewing machine 10, and the needle guard 16 is rotated about the shaft 20 in the opening 22, a selected face **24*a–f* of the guard member 18 is positioned towards the needle 12, after which the screw 30 is tightened in the bore 32 to bear upon the shaft 20 and secure the guard member 18 at the desired position. During sewing, the needle 12 may be deflected by a particular fabric, such as a seam, and the needle 12 may strike the selected face of the guard member 18 after which the needle is properly positioned by the guard member 18 relative to the looper 14 in order that the looper 14** properly picks up the thread.

Figure 6:
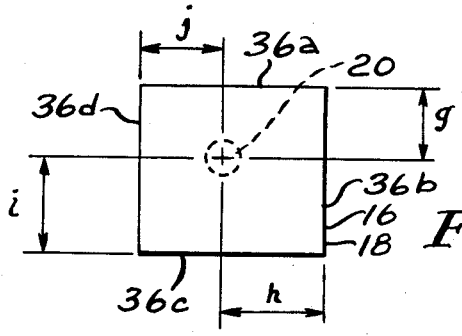
FIG. 6 is a plan view of another embodiment of the needle guard of the present invention.
Figure 7:
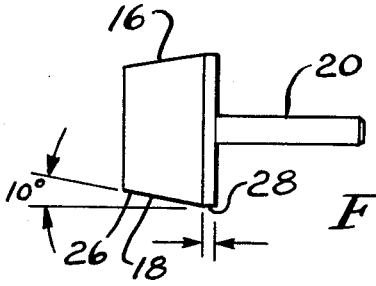
FIG. 7 is an elevational view of the needle guard of FIG. 6.

Another embodiment of the needle guard 16 of the present invention is illustrated in FIGS. 6 and 7, in which like reference numeral designate like parts. In this embodiment, the guard member 18 has four faces **36*a*, 36*b*, 36*c* and 36*d* for selective placement on one side of the lower end of the needle 12. The guard member 18 ha an upper tapered portion 26, and a lower base portion 18 as previously described in connection with FIGS. 1–5. Also, the needle guard 16 has an elongated shaft 20 rotatably mounting the guard member 18 on the sewing machine 18. In a preferred form, the face 36***a* projects a distance of approximately 0.140 inches from the center of the shaft 20, the face 36*b* projects a distance of approximately 0.132 inches from the center of the shaft 20, the face 36*c* projects a distance of approximately 0.157 inches from the center of the shaft 20, and the face 36*d* projects a distance of 0.149 inches from the center of the shaft 20. Thus, the needle guard 16 of FIGS. 6 and 7 has four faces extending a different distance from the center of the shaft 20 towards a lower end of the needle, such that one of the four faces may be selectively positioned facing the needle 12.

Figure 8:
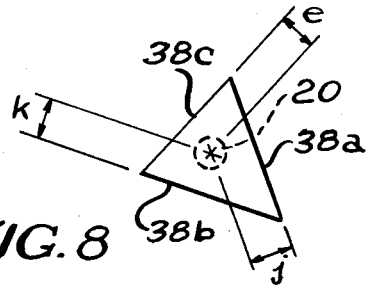
FIG. 8 is a plan view of another embodiment of the needle guard of the present invention.

Another embodiment of the needle guard 16 of the present invention is illustrated in FIG. 8 in which like reference numerals designate like parts. In this embodiment, the guard number 18 has three faces 38*a*, 38*b*, and 38*c* projecting different distances j, k, and 1 from a center of the shaft 20, such that the selected one of three faces may be positioned adjacent a lower end of the needle 12 in a manner as previously as described.

The foregoing detailed description is given for clearness of understanding only, and no unnecessary limitations should be understood therefrom, as modifications will be obvious to those skilled in the art.

What is claimed is:

1. A needle guard for sewing machines, comprising:
a reciprocating needle;
a looper;
a guard member positioned adjacent a lower end of the needle during reciprocation thereof, said guard member having a plurality of separate faces projecting a different distance towards the needle when selectively positioned to face the needle; and
means for selectively positioning one of said faces towards the needle.

2. The guard of claim 1 wherein the positioning means comprises a shaft extending from the guard member, means for rotatably mounting the shaft in the sewing machine, and means for releasably securing the shaft to the sewing machine at a desired position of the guard.

3. The guard of claim 2 wherein the securing means comprises a screw bearing upon the shaft.

4. The guard of claim 2 wherein each of said faces extends a different distance from the center of the shaft to the respective face.

5. The guard of claim 1 wherein the needle is slanted slightly from the vertical direction.

6. The guard of claim 1 wherein each of said faces has an upper tapered portion.

7. The guard of claim 6 wherein each of said faces has a lower vertical base portion.

8. The guard of claim 1 including a rear needle guard on one side of the needle.

9. The guard of claim 1 wherein the guard member has from three to six different faces.

10. A needle guard for a sewing machine, comprising:
a throat plate;
a reciprocating needle;
a looper;
a guard member positioned on one side of the needle, said guard member having a plurality of faces for facing the needle;
a shaft extending from a central portion of the guard member; and
means for rotatably mounting the shaft in the sewing machine for selectively positioning a selected one of said faces towards the needle, with each of said faces projecting a different distance from the center of the shaft towards the needle.

* * * * *